US009976357B2

(12) United States Patent
Moslemi et al.

(10) Patent No.: US 9,976,357 B2
(45) Date of Patent: May 22, 2018

(54) FIXED CUTTER DRILL BIT WITH FLOW GUIDE

(71) Applicant: National Oilwell DHT, L.P., Houston, TX (US)

(72) Inventors: Ali Akbar Moslemi, The Woodlands, TX (US); Jiinjen Albert Sue, The Woodlands, TX (US)

(73) Assignee: National Oilwell DHT, L.P., Houston, TX (US)

( * ) Notice: Subject to any disclaimer, the term of this patent is extended or adjusted under 35 U.S.C. 154(b) by 244 days.

(21) Appl. No.: 14/824,453

(22) Filed: Aug. 12, 2015

(65) Prior Publication Data

US 2017/0044837 A1 Feb. 16, 2017

Related U.S. Application Data

(60) Provisional application No. 62/036,796, filed on Aug. 13, 2014.

(51) Int. Cl.

| | |
|---|---|
| ***E21B 10/42*** | (2006.01) |
| ***E21B 10/60*** | (2006.01) |
| ***E21B 10/61*** | (2006.01) |

(52) U.S. Cl.

CPC ..... *E21B 10/602* (2013.01); *E21B 10/42* (2013.01); *E21B 10/61* (2013.01); *E21B 2010/607* (2013.01)

(58) Field of Classification Search

CPC ..... E21B 10/602; E21B 10/42; E21B 10/43; E21B 10/61

See application file for complete search history.

(56) References Cited

U.S. PATENT DOCUMENTS

| | | | | |
|---|---|---|---|---|
| 4,460,053 | A | 7/1984 | Jurgens et al. | |
| 6,079,507 | A * | 6/2000 | Trujillo | E21B 10/18 175/339 |
| 7,237,628 | B2 | 7/2007 | Desai et al. | |
| 8,020,639 | B2 | 9/2011 | Wells et al. | |
| 8,997,897 | B2 | 4/2015 | De Reynal | |
| 2009/0120008 | A1 | 5/2009 | Lockwood et al. | |
| 2009/0283334 | A1 | 11/2009 | Durairajan et al. | |
| 2010/0270078 | A1 | 10/2010 | Wells et al. | |
| 2012/0292117 | A1 * | 11/2012 | John | E21B 10/00 175/428 |

(Continued)

OTHER PUBLICATIONS

Search Report and Written Opinion dated Feb. 18, 2016 for counterpart PCT application PCT/US2015/044804; (10 pages).

(Continued)

*Primary Examiner* — Giovanna C. Wright
*Assistant Examiner* — Yanick A Akaragwe
(74) *Attorney, Agent, or Firm* — Jonathan M. Pierce; Porter Hedges LLP

(57) ABSTRACT

A drill bit comprises a bit body having a body face. A plurality of fixed blades extends from the bit body. Each of the plurality of fixed blades has a leading face and a trailing face. A plurality of nozzles is disposed on the body face to flow drilling fluid out of the bit body. A plurality of flow guides direct a portion of the drilling fluid away from the bit body. Each of the plurality of flow guides extends longitudinally from the body face, and along the leading face of one of the plurality of fixed blades.

24 Claims, 5 Drawing Sheets

(56) References Cited

U.S. PATENT DOCUMENTS

| | | | |
|---|---|---|---|
| 2013/0020134 | A1 | 1/2013 | Azar et al. |
| 2015/0068816 | A1 | 3/2015 | Velvaluri et al. |

OTHER PUBLICATIONS

Ali A. Moslemi, Reza Rahmani, Ryan Graham, and Brad Ivie, Hydraulic Design of Shale Drill bit Using and Integrated Numerical and Experimental Approach; SPE/IADC Drilling Conference and Exhibition; Mar. 17-19, 2015 (18 pages).

* cited by examiner

FIXED CUTTER DRILL BIT WITH FLOW GUIDE

CROSS-REFERENCE TO RELATED APPLICATIONS

This application claims priority to U.S. Provisional Application Ser. No. 62/036,796 filed on Aug. 13, 2014, and entitled "FIXED CUTTER DRILL BIT WITH FLOW GUIDE". The priority application is incorporated herein by reference.

BACKGROUND

This disclosure relates generally to rotary earth-boring drill bits. More particularly, this disclosure relates to a fixed cutter drill bit with features that improve drill bit hydraulics.

Rotary drill bits are typically mounted on the lower end of a drill string that is being rotated from the surface or by downhole motors. As the drill string is rotated, tension applied to the drill string is reduced to increase the weight on the bit so that the bit engages and drills a borehole into the earthen formation.

Two types of available drill bits are roller cone bits and fixed cutter bits. Roller cone bits often include a plurality of conical rollers that are rotatably mounted to the bit and imbedded with a plurality of cutting elements. Fixed cutter bits rely on a plurality of fixed blades angularly spaced about the bit and imbedded with a plurality of cutting elements. The cutting elements for either bit design are often formed from extremely hard materials such as polycrystalline diamond, cubic boron nitride, and tungsten carbide. The configuration or layout of the rollers, blades, and cutting elements vary widely between bit designs depending heavily on the formation to be drilled.

Both roller cone and fixed cutter drill bits utilize drilling fluid as a means to flush the drilled earth away from the drill bit and transport it to the surface. While the bit is rotated, drilling fluid is pumped through the drill string and directed out of the face of the drill bit through one or more nozzles. The drilling fluid acts to cool the bit and remove formation cuttings from the bit face and the bottom of the borehole. The behavior and performance of the drilling fluid as it acts on and around the drill bit is known as "bit hydraulics."

In many fixed cutter drill bits, the nozzles are oriented such that high velocity drilling fluid is directed toward the formation at the bottom of the hole. As the drilling fluid impacts the formation and returns upward past the face of the drill bit, it cleans and cools the cutting elements of the drill bit. Because the drilling fluid first impacts the formation at the bottom of the hole, by the time it contacts the cutting elements of the drill bit the velocity of the drilling fluid is reduced from its initial velocity upon exiting the nozzles. This reduced velocity may limit the amount of cooling and cleaning that can be achieved by the drilling fluid.

Inadequate cooling of the cutting elements may lead to decreased life of the drill bit due to high temperatures supporting increased erosion and wear of the cutting elements. If formation cuttings are not cleaned from the cutting elements of a fixed cutter drill bit, formation materials may build up on the cutting elements and greatly increase drilling times.

Some types of earthen formations, sometimes referred to as plastic shales or simply plastic formations, are difficult to drill efficiently. Upon action of the cutting elements, these formations generate cuttings in the form of long ribbons of drilled material that tend to accumulate between the cutting elements of the drill bit, a phenomenon called "bit balling." When the bit is balled, it is no longer possible for the cutting elements to engage the formation, regardless of the weight applied on the drill bit. Drilling of the borehole pauses for the drill bit to be retrieved and cleaned by means other than pumping drilling fluid through the drill string.

Thus, there is a continuing need in the art for methods and apparatus for improved fixed cutter drill bit designs that improve drill bit hydraulics.

BRIEF SUMMARY OF THE DISCLOSURE

In some aspects, a drill bit comprises a bit body having a body face. The drill bit further comprises a plurality of fixed blades extending from the bit body, each of the plurality of fixed blades having a leading face and a trailing face. The drill bit further comprises a plurality of nozzles disposed on the body face to flow drilling fluid out of the bit body. The drill bit further comprises a plurality of flow guides to direct a portion of the drilling fluid away from the bit body. Each of the plurality of flow guides extends longitudinally from the body face. Each of the plurality of flow guides extends along the leading face of one of the plurality of fixed blades. At least one of the plurality of fixed blades may have a tip profile, and at least one of the plurality of flow guides may comprise a guide edge that follows the tip profile. The body face may have a waterway profile, and at least one of the plurality of flow guides may comprise a guide edge that follows the waterway profile. At least one of the plurality of fixed blades may have a tip profile, the body face may have a waterway profile, and at least one of the plurality of flow guides may comprise a guide edge that is steeper than the tip profile and the waterway profile. The drill bit may further comprise cutting elements disposed on the leading face of one of the plurality of fixed blades; at least one of the plurality of flow guides may comprise a guide edge; the guide edge and the cutting elements may form a continuous flow channel having a flow entrance area; at least one of the plurality of nozzles may be operable to direct the drilling fluid toward the flow entrance area of the continuous flow channel. The drilling fluid may be accelerated in the continuous flow channel. At least one of the plurality of flow guides may comprise a hydrophobic material. At least one of the plurality of flow guides may comprise a front edge offset from an inside edge of at least one of the plurality of fixed blades. At least one of the plurality of nozzles may produce a flow jet, and the flow jet may be essentially parallel to the front edge. Each of the plurality of flow guides may increase hydraulic shear stress on a plurality of cutting elements disposed on each of the plurality of fixed blades. At least one of the plurality of nozzles may produce a flow jet; the flow jet may be essentially parallel to the leading face of a first one of the plurality of fixed blades; the flow jet may be closer to the leading face of the first one on the plurality of fixed blades than to the trailing face of a second one of the plurality of fixed blades.

In some aspects, a drill bit comprises a bit body, a plurality of fixed blades extending from the bit body, a plurality of cutting elements disposed on each of the plurality of fixed blades, a junk slot located in between a leading face of a first one of the plurality of fixed blades and a trailing face of a second one of the plurality of fixed blades, at least one nozzle disposed in the bit body and leading into the junk slot, and a flow guide protruding from the leading face of the first one of the plurality of fixed blades and from the bit body. The flow guide is operable to direct a fluid from the at least one nozzle in front of the plurality of cutting elements disposed on the first one of the plurality of blades. The first one of the plurality of blades may have a tip profile, and the flow guide may comprise a guide edge that follows the tip profile. The junk slot may have a waterway profile, and the flow guide may comprise a guide edge that follows the waterway profile. The first one of the plurality of blades may have a tip profile; the junk slot may have a waterway profile; the flow guide may comprise a guide edge that is steeper than the tip profile and the waterway profile.

In some aspects, a drill bit comprises a bit body, a plurality of fixed blades extending from the bit body, a plurality of cutting elements disposed on each of the plurality of fixed blades, a junk slot located in between a leading face of a first one of the plurality of fixed blades and a trailing face of a second one of the plurality of fixed blades, at least one nozzle disposed on the bit body and leading into the junk slot, a flow guide protruding from the leading face of the first one of the plurality of fixed blades and from the bit body, the flow guide having a guide edge, and a continuous flow channel formed at least partially by the guide edge and the plurality of cutting elements disposed on the first one of the plurality of fixed blades. The continuous flow channel has a flow entrance area, and the at least one nozzle directs a fluid toward the flow entrance area of the continuous flow channel. The at least one nozzle may produce a flow jet; the flow jet may be essentially parallel to the leading face of the first one on the plurality of fixed blades; the flow jet may be closer to the leading face of the first one on the plurality of fixed blades than to the trailing face of the second one of the plurality of fixed blades. The first one of the plurality of blades may have a tip profile, and the guide edge may follow the tip profile. The junk slot may have a waterway profile, and the guide edge may follow the waterway profile. The first one of the plurality of blades may have a tip profile, the junk slot may have a waterway profile; the guide edge may be steeper than the tip profile and the waterway profile.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
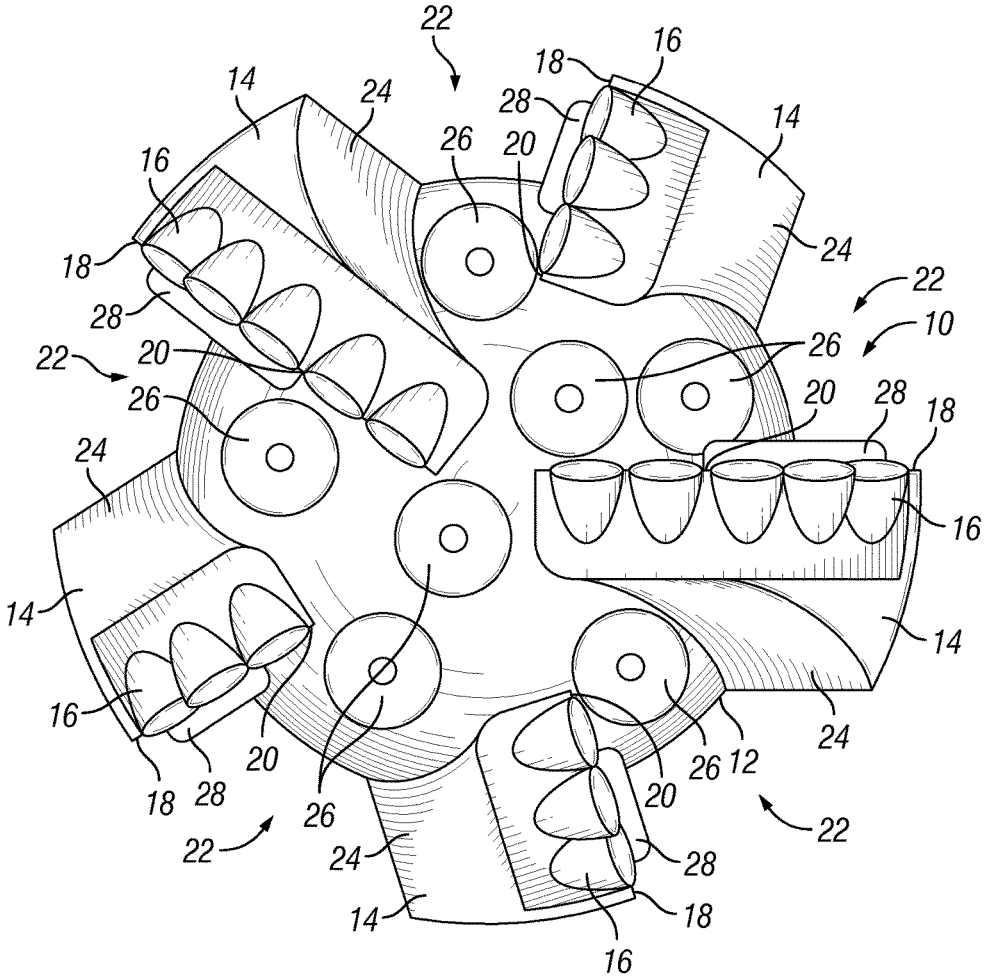
FIG. 1 is an end view of a drill bit with flow guide.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring initially to FIG. 1, a fixed cutter drill bit 10 comprises a bit body 12 having a plurality of angularly spaced fixed blades 14. In the end view of FIG. 1, the bit would be rotated counter-clockwise to drill. Each fixed blade 14 includes a plurality of cutting elements 16 disposed on a shoulder 18 on a leading face 20 of the fixed blade 14. Junk slots 22 are formed between each leading face 20 and trailing face 24 of an adjacent fixed blade 14. A plurality of nozzles 26 is disposed in the bit body 12 in between the fixed blades 14, and lead into the junk slots 22. The nozzles 26 are either flushed or recessed below the surface of the bit body 12.

Figure 2:
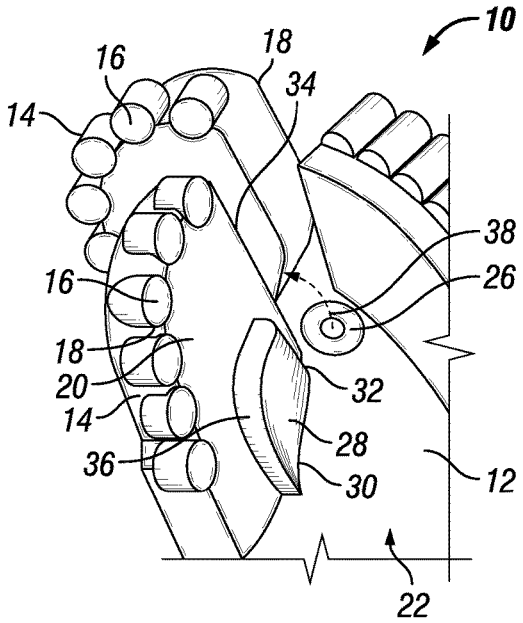
FIG. 2 is a partial perspective view of a drill bit with flow guide.

The leading face 20 of each fixed blade 14 also includes a flow guide 28. Referring now to FIGS. 1 and 2, the flow guide 28 protrudes from the leading face 20 of the fixed blade 14 into the junk slot 22. The flow guide 28 may be defined by a base 30, a front edge 32, and a guide edge 36. In certain embodiments, the base 30 is disposed on the bit body 12. In other words, the flow guide 28 may extend longitudinally from the bit body 12 along the leading face 20 of the fixed blade 14. The flow guide 28 may include a front edge 32 (in FIG. 2) that is offset from an inside edge 34 (in FIG. 2) of the fixed blade 14. The front edge 32 may be inclined or curved relative to a surface perpendicular to the fixed blade 14. The flow guide 28 may also include a guide edge 36 that may be offset from and substantially follow the profile of the shoulder 18 of the fixed blade 14.

A nozzle 26 and a flow guide 28 may be said to be operatively associated if, in use, (1) the flow jet exiting the nozzle 26 is closer to the leading face 20 of one particular blade of the plurality of fixed blades 14 than to the leading face of any other blade of the plurality of fixed blades, and (2) the flow guide 28 protrudes from the leading face 20 of this particular blade. The nozzle 26 and the flow guide 28 shown in the partial view of FIG. 2 are operatively associated. When the nozzle 26 and the flow guide 28 are operatively associated, a flow jet of drilling fluid 38 produced by the nozzle 26 may be essentially parallel to the front edge 32. In some embodiments, the flow jet being essentially parallel to the front edge means that the flow jet, upon exiting the nozzle 26, does not directly impinge the front edge 32. In some embodiments, the flow jet being essentially parallel to the front edge means that the fluid velocity at the front edge 32 is reduced compared to the fluid velocity upon exit of the nozzle 26 by at least 50%.

In some embodiments, the flow guide 28 may comprise a metal such as iron (Fe), nickel (Ni), cobalt (Co), copper (Cu), aluminum (Al), or titanium (Ti) and alloys thereof, a ceramic material, such as alumina, and/or a polymer, such as a thermoplastic. The flow guide 28 may optionally be coated with a hydrophobic material and/or a wear and erosion resistant material, such as polyethylene reinforced with metallic inclusions or electroless nickel-phosphorus (Ni—P) alloy with ceramic inclusions. Alternatively, the flow guide 28 may be made almost entirely of a hydrophobic material.

In some embodiments, the flow guide 28 may be integral to the fixed blade 14, for example machined out of a piece of steel used to make the drill bit 10. Alternatively, the flow guide 28 may be made separately from the drill bit 10, for example by machining or 3D printing, and then bonded to the fixed blade 14, such as by brazing or gluing. The flow guide 28 may also be secured to the fixed blade 14, such as by bolting.

Figure 3:
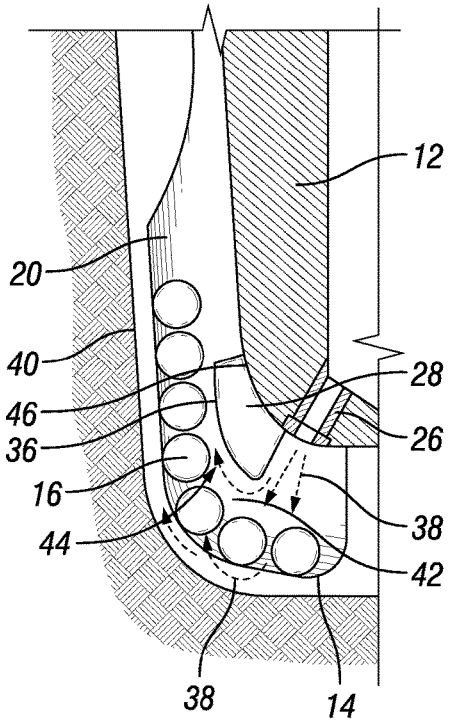
FIG. 3 is a partial sectional view of a drill bit illustrating the flow of drilling fluid.

Referring now to FIG. 3, a partial sectional view of the drill bit 10 is shown to illustrate the flow of drilling fluid 38 through nozzle 26 and around the drill bit 10 disposed in a wellbore 40. The bit body 12 has a body face 46 from which the fixed blades 14 extend. In the shown example, the face 46 is convex. In general, a bit body having a convex face is such that a line joining any two points of the convex face lies in or on the bit body. In some embodiments, the convex face 46 may be hemispherical. In other embodiments, the convex face 46 may be truncated conical. In yet other embodiments, the convex face 46 may be parabolic. In yet other embodiments, the convex face 46 may be faceted. The nozzle 26 is located in the bit body 12, and is flushed with or recessed below the convex face 46. Drilling fluid 38 exits the nozzle 26 and flows back upward through the wellbore 40. As shown, the flow guide 28 extends longitudinally from the convex face 46 along the leading face 20 of the fixed blade 14. The flow guide 28 directs a portion of the drilling fluid 38 away from the bit body 12 and toward the cutting elements 16. At a constant flow rate, the drilling fluid 38 will be accelerated by the restriction formed by the flow guide 28 resulting in an increased flow velocity over the cutting elements 16. In addition, in absence of the flow guide 28 operatively associated with the nozzle 26, the flow velocity over the cutting elements 16 may be lower than in presence of the flow guide. Thus, the flow guide 28 causes an increase of hydraulic shear stress on a plurality of cutting elements 16 disposed on the fixed blade 14.

Figure 3A:
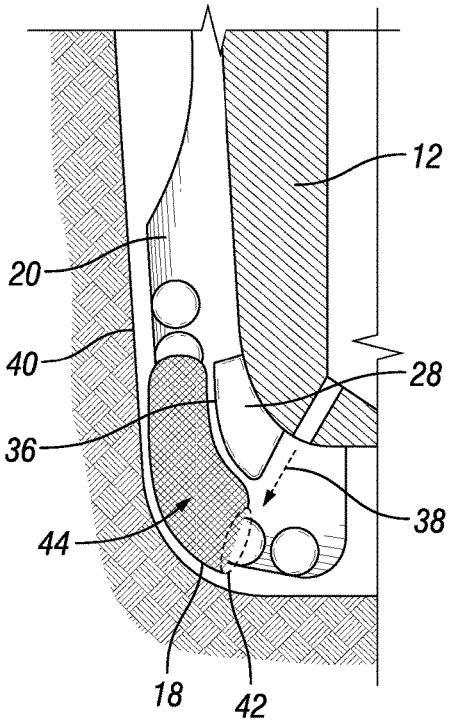
FIG. 3A is a partial sectional view of a drill bit illustrating the flow channel shown in FIG. 3.

In the example shown in FIGS. 3 and 3A, the guide edge 36 and the plurality of cutting elements 16 form a continuous flow channel 44. In some embodiments, the continuous flow channel 44 spans over the width of two or more of the plurality of cutting elements 16. In some embodiments, the continuous flow channel 44 extends over a path including at least half of the length of the shoulder 18 of the fixed blade 14. The flow channel 44 has a flow entrance area 42 located upstream of the flow channel 44 relative to the flow of drilling fluid 38 exiting the nozzle 26. As shown, the nozzle 26 directs the drilling fluid 38 toward the flow entrance area 42

Because the flow guide 28 is disposed within a junk slot 22, the size, shape, and placement of the flow guide 28 is designed so as not to degrade the ability of the drill bit 10 to carry cuttings away from the drill bit 10 via the junk slots 22. In certain embodiments, the size, shape, and placement of the flow guide 28 may be different than the embodiment illustrated herein depending on the configuration of a particular drill bit and the environment in which it is intended to be used. In some embodiments, the flow guide 28 may span about half of the height of the fixed blades 14. In some embodiments, the thickness of the flow guide 28 may vary between 6 and 10 millimeters, that is, the flow guide 28 may protrude from the leading face 20 of one of the fixed blades by a distance that varies between 6 and 10 millimeters. In some embodiments, the flow guide 28 may protrude from the leading face 20 of one of the fixed blades by a distance that varies between 3 and 15 millimeters. In some embodiments, the flow guide 28 may protrude from the leading face 20 of one of the fixed blades by a distance that varies with the size of the junk slot 22.

Figure 4:
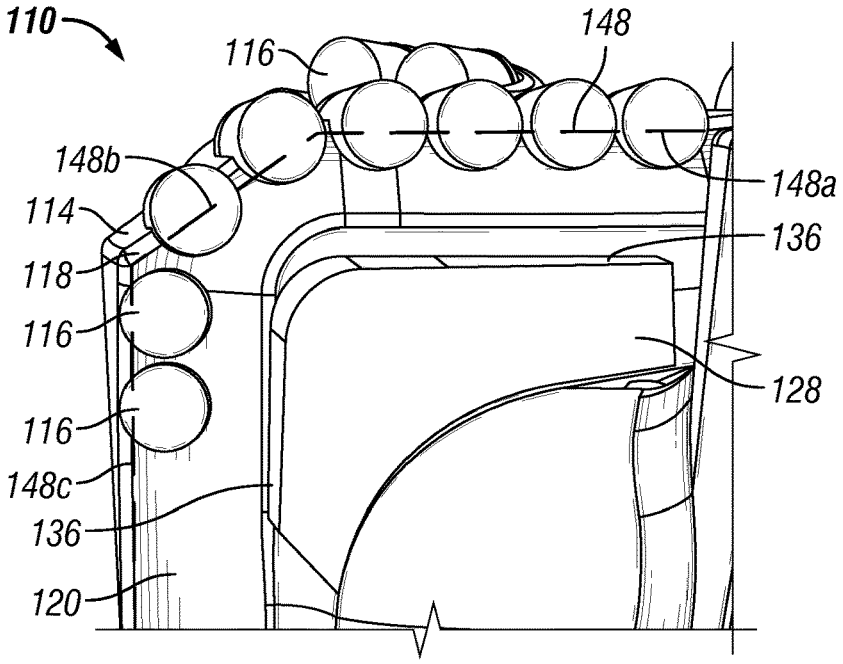
FIG. 4 is a partial perspective view of a drill bit with a flow guide having a guide edge following a tip profile.

FIG. 4 is a partial perspective view of a drill bit 110 with a flow guide 128 having a guide edge 136 following a tip profile. Numerical simulations show that this type of configuration is particularly efficient to increase of hydraulic shear stress on a plurality of cutting elements 116 disposed on a fixed blade 114 of the drill bit 110. For example, the magnitude the hydraulic shear stress computed in this configuration is higher than the magnitude the hydraulic shear stress computed in a configuration where a plurality of discrete flow obstacles protrude from a leading face 120 of the fixed blade 114.

A first blade of the plurality of fixed blades 114 has a shoulder 118. An outline of the shoulder shape projected in a longitudinal half plane is the profile of the shoulder tip. In the example of FIG. 4, the tip profile 148 comprises a flat portion 148*a* that spans over the nose of the drill bit 110, a beveled portion 148*b* over the shoulder of the drill bit 110, and another flat portion 148*c* that spans over the gauge of the drill bit 110. The guide edge 136 of the flow guide 128 is offset inwardly from, and substantially follows the tip profile 148.

Figure 5:
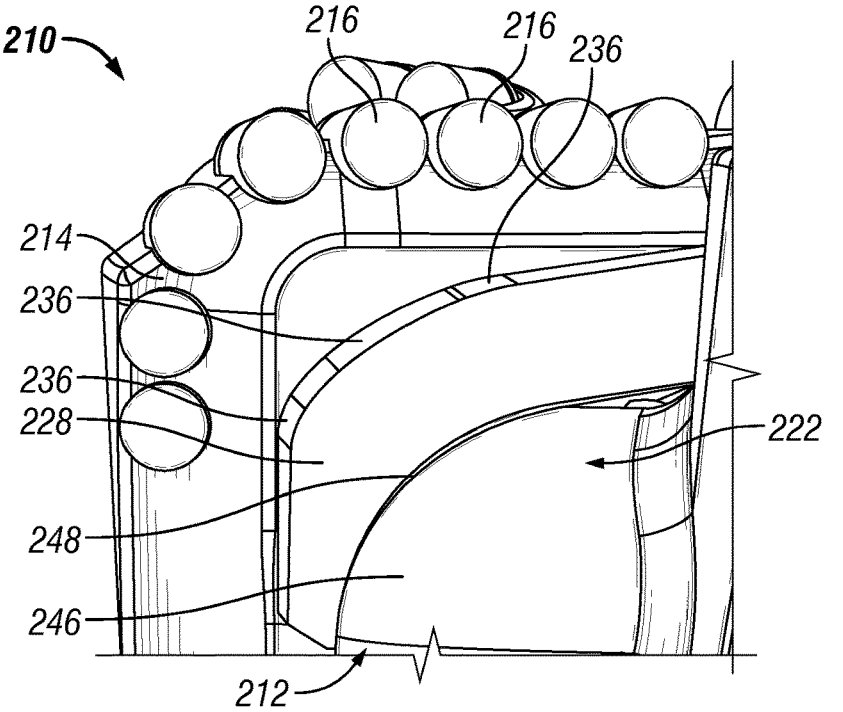
FIG. 5 is a partial perspective view of a drill bit with flow guide having a guide edge following a waterway profile.

FIG. 5 is a partial perspective view of a drill bit 210 with a flow guide 228 having a guide edge 236 following a waterway profile. Numerical simulations also show that this type of configuration is efficient to increase of hydraulic shear stress on a plurality of cutting elements 216 disposed on a fixed blade 214. In addition, this configuration of the guide edge 236 may also deflect ribbons of cuttings generated by the cutting elements 216 toward the gauge of the drill bit 210.

The drill bit 210 has a bit body 212 from which the plurality of blades 214 extend. The bit body 212 has a face 246 which is convex. A junk slot 222 is formed in between each pair of fixed blade. An outline of the junk slot shape projected in a longitudinal half plane is the waterway profile. It is the same as an outline of the bit body shape projected in a longitudinal half plane. In the example of FIG. 5, the waterway profile 248 comprises a series of arcs. The guide edge 236 is offset outwardly from, and follows the waterway profile 248. In this case, the flow guide 228 extends longitudinally from the convex body face 246 by an essentially constant height.

Figure 6:
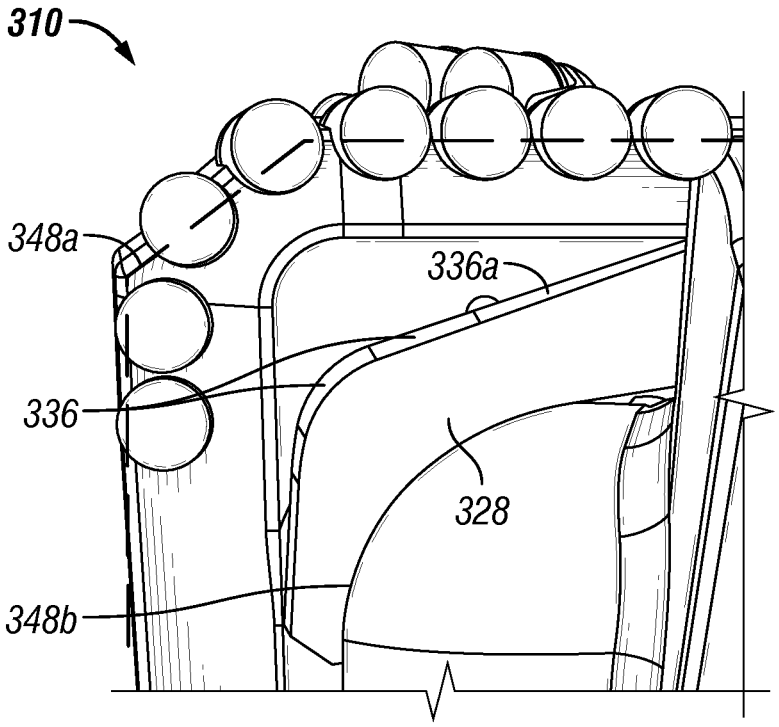
FIG. 6 is a partial perspective view of a drill bit with flow guide having a guide edge following a steep profile.

FIG. 6 is a partial perspective view of a drill bit 310 with a flow guide 328 having a guide edge 336 following a profile that is steeper than both the tip profile 348*a* and the waterway profile 348*b*. A substantial portion 336*a* of the guide edge 336 is tilted at a shallower angle with respect to the longitudinal axis of the drill bit than both the tip profile 348*a* and the waterway profile 348*b*.

Figure 7:
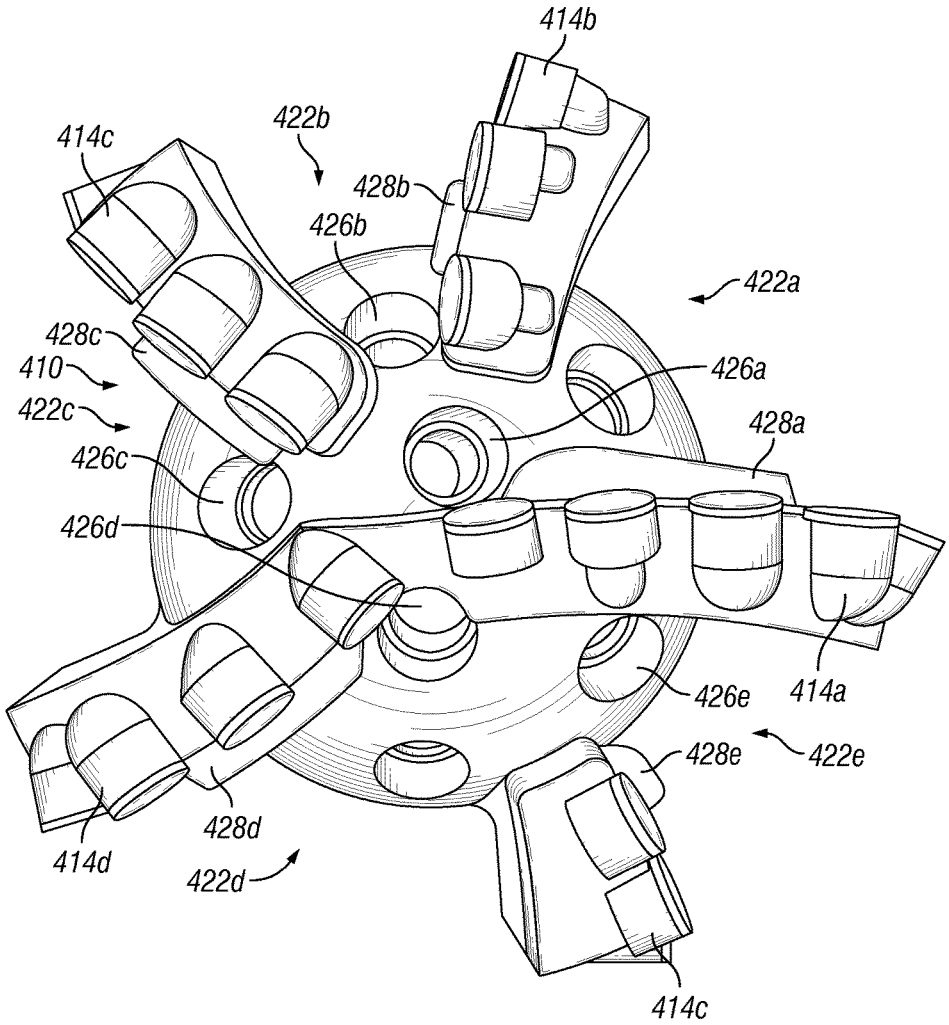
FIG. 7 is a picture of a drill bit with flow guide.

FIG. 7 is a picture of a drill bit 410 with flow guide. Two similar versions of the drill bit were made, one version to drill wellbores having a diameter of 8.5 inches, and another version to drill wellbores having a slightly bigger diameter of 8.75 inches.

In the example of FIG. 7, the drill bit 410 has 5 blades 414*a*-414*e*, forming 5 junk slots 422*a*-422*e* in between. A flow guide extends longitudinally from the convex face of the bit body along the leading face of each of the 5 blades; namely, the drill bit 410 comprises 5 flow guides 428*a*-428*e*. Each of the flow guides is operatively associated with at least one nozzle, 426*a*-426*e*, respectively. The nozzles are recessed below the convex face of the bit body. Each of the nozzles 426*a*-426*e* produces a flow jet that is essentially parallel to one of the leading faces of the fixed blades 414*a*-414*e*. Each of the nozzles 426*a*-426*e* leads into one of the junk slots 422*a*-422*e*. At least some of the nozzles 426*a*-426*e* are positioned in the junk slots 422*a*-422*e* to produce a flow jet that is closer to the leading face of the first fixed blade forming the junk slot than to the trailing face of the second, adjacent fixed blade forming the junk slot.

Note that the drill bit 410 includes additional nozzles that are not associated with a flow guide, and that are not positioned in the junk slots to produce a flow jet that is closer to the leading face of the first fixed blade forming the junk slot than to the trailing face of the second fixed blade forming the junk slot.

Without being limited to any theory, it is believed that the hydraulic performance of the drill bit 410 reduces balling in shale formations, and permits the effective cleaning of larger cuttings than a drill bit without flow guide. Thus, a wellbore may be drilled at a higher rate of penetration, as shown in the following examples.

Example 1

A drill bit with flow guide as shown in FIG. 7 was used to drill through the Marcellus shale formation in the state of Pennsylvania, U.S.A. The drill bit with flow guide was mounted to a bent motor to first drill a curved section of the wellbore about 1,250 feet long in sliding mode, and then drill a lateral section of the wellbore about 5,500 feet long in rotating mode. The wellbore was 8.5 inches diameter. The drill bit with flow guide achieved an average rate of penetration of 110 feet per hours in the curved section, and an average of more than 145 feet per hour in the lateral section, leading to an overall average of 139 feet per hour. In a first offset wellbore having the same diameter and in the same formation, a drill bit without flow guide achieved an average rate of penetration of 77 feet per hour (a reduction of nearly 45% compared to the drill bit shown in FIG. 7). In a second offset wellbore having the same diameter and in the same formations, another drill bit without flow guide achieved an average rate of penetration of 105 feet per hour (a reduction of nearly 25% compared to the drill bit shown in FIG. 7).

Example 2

A drill bit with flow guide as shown in FIG. 7 was used to drill in the Denver-Julesburg Basin in Colorado, U.S.A. The wellbore was drilled through the Parkman, Sussex and Shannon formations, which are composed of shale and siltstone mixes. The drill bit with flow guide was mounted to a mud motor to drill a vertical section about 5,500 feet long of the wellbore. The wellbore was 8.75 inch diameter. The drill bit with flow guide achieved an average rate of penetration of 359 feet per hour. This rate of penetration was compared to the rate of penetration achieved with drill bits without flow guide in offset wellbores similar length (at least 4,500 feet) and depth range (from about 1,000 feet deep to about 7,500 feet deep). The rate of penetration achieved with the drill bit with flow guide was the highest. The next best average rate of penetration was 271 feet per hour (a reduction of nearly 25%). The third best average rate of penetration was 243 feet per hour (a reduction of 32%). The rate of penetration achieved with the drill bit with flow guide, averaged over all the offset wellbores drilled in this diameter was 201 feet per hour (a reduction of nearly 45%).

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A drill bit comprising:

a bit body, the bit body having a body face;

a plurality of fixed blades extending from the bit body, each of the plurality of fixed blades having a leading face and a trailing face;

a plurality of nozzles disposed on the body face to flow drilling fluid out of the bit body; and a plurality of flow guides to direct a portion of the drilling fluid away from the bit body, wherein each of the plurality of flow guides extends longitudinally from the body face, and wherein each of the plurality of flow guides extends along the leading face of one of the plurality of fixed blades.

2. The drill bit of claim 1, wherein at least one of the plurality of fixed blades has a tip profile over the nose portion of the drill bit, and wherein at least one of the plurality of flow guides comprises a guide edge that follows the tip profile.

3. The drill bit of claim 1, wherein the body face has a waterway profile over the nose portion of the drill bit, and wherein at least one of the plurality of flow guides comprises a guide edge that follows the waterway profile.

4. The drill bit of claim 1, wherein at least one of the plurality of fixed blades has a tip profile over the nose portion of the drill bit, wherein the body face has a waterway profile over the nose portion of the drill bit, and wherein at least one of the plurality of flow guides comprises a guide edge that is steeper than the tip profile and the waterway profile.

5. The drill bit of claim 1 further comprising cutting elements disposed on the leading face of one of the plurality of fixed blades, wherein at least one of the plurality of flow guides comprises a guide edge, wherein the guide edge and the cutting elements form contiguous sides of a continuous flow channel having a flow entrance area, and wherein at least one of the plurality of nozzles is operable to direct the drilling fluid toward the flow entrance area of the continuous flow channel.

6. The drill bit of claim 5 wherein the drilling fluid is accelerated in the continuous flow channel.

7. The drill bit of claim 1 wherein at least one of the plurality of flow guides comprises a hydrophobic material.

8. The drill bit of claim 1 wherein at least one of the plurality of flow guides comprises a front edge offset from an inside edge of at least one of the plurality of fixed blades, wherein the inside edge is the radially innermost edge of the at least one of the plurality of fixed blades.

9. The drill bit of claim 8 wherein at least one of the plurality of nozzles produces a flow jet, and wherein the flow jet, upon exiting the at least one of the plurality of nozzles, is essentially parallel to the front edge.

10. The drill bit of claim 1 wherein each of the plurality of flow guides increases hydraulic shear stress on a plurality of cutting elements disposed on each of the plurality of fixed blades.

11. The drill bit of claim 1 wherein at least one of the plurality of nozzles produces a flow jet, wherein the flow jet is essentially parallel to the leading face of a first one of the plurality of fixed blades, and wherein the flow jet is closer to the leading face of the first one of the plurality of fixed blades than to the trailing face of a second one of the plurality of fixed blades.

12. A drill bit comprising:

a bit body;

a plurality of fixed blades extending from the bit body;

a plurality of cutting elements disposed on each of the plurality of fixed blades;

a junk slot located in between a leading face of a first one of the plurality of fixed blades and a trailing face of a second one of the plurality of fixed blades;

at least one nozzle disposed in the bit body and leading into the junk slot; and a flow guide protruding from the leading face of the first one of the plurality of fixed blades and from the bit body, wherein the flow guide is operable to direct a fluid from the at least one nozzle in front of the plurality of cutting elements disposed on the first one of the plurality of blades, wherein the flow guide protrudes from the leading face of the first one of the plurality of fixed blades by a thickness that varies between 3 and 15 mm.

13. The drill bit of claim 12 wherein the first one of the plurality of blades has a tip profile, and wherein the flow guide comprises a guide edge that follows the tip profile.

14. The drill bit of claim 12 wherein the junk slot has a waterway profile, and wherein the flow guide comprises a guide edge that follows the waterway profile.

15. The drill bit of claim 12 wherein the first one of the plurality of blades has a tip profile, wherein the junk slot has a waterway profile, and wherein the flow guide comprises a guide edge that is steeper than the tip profile and the waterway profile.

16. A drill bit comprising:

a bit body;

a plurality of fixed blades extending from the bit body;

a plurality of cutting elements disposed on each of the plurality of fixed blades;

a junk slot located in between a leading face of a first one of the plurality of fixed blades and a trailing face of a second one of the plurality of fixed blades;

at least one nozzle disposed on the bit body and leading into the junk slot;

a flow guide protruding from the leading face of the first one of the plurality of fixed blades and from the bit body, the flow guide having a guide edge; and a continuous flow channel formed at least partially by the guide edge and the plurality of cutting elements disposed on the first one of the plurality of fixed blades, the continuous flow channel having a flow entrance area, wherein the at least one nozzle directs a fluid toward the flow entrance area of the continuous flow channel.

17. The drill bit of claim 16 wherein the at least one nozzle produces a flow jet, wherein the flow jet is essentially parallel to the leading face of the first one of the plurality of fixed blades, and wherein the flow jet is closer to the leading face of the first one of the plurality of fixed blades than to the trailing face of the second one of the plurality of fixed blades.

18. The drill bit of claim 17 wherein the first one of the plurality of blades has a tip profile over the nose portion of the drill bit, and wherein the guide edge follows the tip profile.

19. The drill bit of claim 17 wherein the junk slot has a waterway profile over the nose portion of the drill bit, and wherein the guide edge follows the waterway profile.

20. The drill bit of claim 17 wherein the first one of the plurality of blades has a tip profile over the nose portion of the drill bit, wherein the junk slot has a waterway profile over the nose portion of the drill bit, and wherein the guide edge is steeper than the tip profile and the waterway profile.

21. A drill bit comprising:

a bit body, the bit body having a body face;

a plurality of fixed blades extending from the body face, each of the plurality of fixed blades having a leading face, a trailing face, and a shoulder;

a junk slot located in between a leading face of a first one of the plurality of fixed blades and a trailing face of a second one of the plurality of fixed blades; and a flow guide located in the junk slot, wherein the flow guide extends axially from a base surface that is located in the junk slot and on the body face, by about half of a height of the first one of the plurality of fixed blades, and up to a guide edge surface that is offset inwardly from the shoulder of the first one of the plurality of fixed blades, and wherein the guide edge surface spans between the leading face of the first one of the plurality of fixed blades and a surface of the flow guide that extends along the leading face of the first one of the plurality of fixed blades.

22. The drill bit of claim 21, wherein the flow guide protrudes from the leading face of the first one of the plurality of fixed blades by a thickness that varies between 3 and 15 mm.

23. A drill bit comprising:

a bit body;

a plurality of fixed blades extending from the bit body;

a plurality of cutting elements disposed on each of the plurality of fixed blades;

a junk slot located in between a leading face of a first one of the plurality of fixed blades and a trailing face of a second one of the plurality of fixed blades;

at least one nozzle disposed on the bit body and leading into the junk slot; and a flow guide protruding from the leading face of the first one of the plurality of fixed blades and from the bit body, the flow guide having a guide edge, wherein the guide edge forms one of two contiguous sides of a continuous flow channel, wherein at least two of the plurality of cutting elements form another of the two contiguous sides of the continuous flow channel, and wherein the at least one nozzle directs a fluid toward the flow entrance area of the continuous flow channel.

24. The drill bit of claim 23, wherein the continuous flow channel extends over a path including at least half of a length of a shoulder of the first one of the plurality of fixed blades.

* * * * *